US007824566B2

(12) United States Patent
Scheidler

(10) Patent No.: US 7,824,566 B2
(45) **Date of Patent: *Nov. 2, 2010**

(54) METHODS AND COMPOSITIONS FOR IMPROVING LIGHT-FADE RESISTANCE AND SOIL REPELLENCY OF TEXTILES AND LEATHERS

(76) Inventor: Karl J. Scheidler, 1357 State Route 28, Loveland, OH (US) 45140

( * ) Notice: Subject to any disclaimer, the term of this patent is extended or adjusted under 35 U.S.C. 154(b) by 908 days.

This patent is subject to a terminal disclaimer.

(21) Appl. No.: 11/566,460

(22) Filed: Dec. 4, 2006

(65) Prior Publication Data

US 2007/0085050 A1 Apr. 19, 2007

Related U.S. Application Data

(63) Continuation-in-part of application No. 10/887,034, filed on Jul. 8, 2004, now Pat. No. 7,157,018.

(60) Provisional application No. 60/485,623, filed on Jul. 8, 2003.

(51) Int. Cl.

| | |
|---|---|
| ***D06M 15/643*** | (2006.01) |
| ***D06M 15/263*** | (2006.01) |
| ***C11D 17/08*** | (2006.01) |
| ***C11D 3/00*** | (2006.01) |
| ***D06P 5/00*** | (2006.01) |
| ***D06P 1/00*** | (2006.01) |

(52) U.S. Cl. ..... 252/8.62; 252/8.61; 510/407; 510/412; 8/115.51; 8/490; 8/636

(58) Field of Classification Search ..... 252/8.62, 252/8.61; 510/407, 412; 8/115.51, 490, 8/636

See application file for complete search history.

(56) References Cited

U.S. PATENT DOCUMENTS

| | | | | |
|---|---|---|---|---|
| 260,168 | A | | 6/1882 | Couch |
| 1,623,791 | A | | 4/1927 | Kara-Joseph |
| 1,811,809 | A | | 6/1931 | Schwarzkopf |
| 1,942,523 | A | | 1/1934 | Weiss et al. |
| 2,006,192 | A | | 6/1935 | Babcock |
| 2,015,943 | A | | 10/1935 | Loges |
| 2,759,860 | A | | 8/1956 | Pallos |
| 3,068,120 | A | | 12/1962 | Jacobson et al. |
| 3,373,126 | A | | 3/1968 | Lehrman et al. |
| 3,374,235 | A | | 3/1968 | Varsanyi et al. |
| 3,404,992 | A | | 10/1968 | Strobel et al. |
| 3,462,384 | A | | 8/1969 | Kokoszka et al. |
| 3,547,854 | A | | 12/1970 | Roth et al. |
| 3,567,498 | A | | 3/1971 | Rafferty et al. |
| 3,600,325 | A | | 8/1971 | Kaufman et al. |
| 3,625,890 | A | | 12/1971 | Sramek |
| 3,630,949 | A | | 12/1971 | Brux et al. |
| 3,639,309 | A | | 2/1972 | Starkman et al. |
| 3,644,241 | A | | 2/1972 | Falivene |
| 3,674,418 | A | | 7/1972 | Lyons et al. |
| 3,674,688 | A | | 7/1972 | Schwartz et al. |
| 3,686,120 | A | | 8/1972 | Creeley |
| 3,753,772 | A | | 8/1973 | Cohen et al. |
| 3,791,803 | A | * | 2/1974 | Andress et al. ..... 44/343 |
| 3,965,014 | A | | 6/1976 | Giordano et al. |
| 4,129,505 | A | | 12/1978 | Dasher et al. |
| 4,139,479 | A | | 2/1979 | Goffinet et al. |
| 4,161,449 | A | | 7/1979 | Smith et al. |
| 4,296,165 | A | | 10/1981 | Kakar et al. |
| 4,313,978 | A | | 2/1982 | Stevens et al. |
| 4,540,497 | A | | 9/1985 | Chang et al. |
| 4,552,777 | A | | 11/1985 | Dente et al. |
| 4,559,151 | A | | 12/1985 | Pregozen et al. |
| 4,560,487 | A | | 12/1985 | Brinkley |
| 4,565,641 | A | | 1/1986 | Chang et al. |
| 4,566,981 | A | | 1/1986 | Howells |
| 4,606,737 | A | | 8/1986 | Stern |
| 4,661,268 | A | | 4/1987 | Jacobson et al. |
| 4,668,406 | A | | 5/1987 | Chang |
| 4,668,726 | A | | 5/1987 | Howells |
| 4,671,884 | A | | 6/1987 | McKinnon et al. |
| 4,676,915 | A | | 6/1987 | Steltenkamp et al. |
| 4,681,790 | A | | 7/1987 | Fong |
| 4,721,582 | A | | 1/1988 | Nelson |
| 4,748,267 | A | | 5/1988 | Chang |
| 4,786,484 | A | | 11/1988 | Nelson |
| 4,806,254 | A | | 2/1989 | Church |
| 4,810,411 | A | | 3/1989 | Del Pesco et al. |
| 4,822,373 | A | | 4/1989 | Olson |

(Continued)

FOREIGN PATENT DOCUMENTS

| | | |
|---|---|---|
| DE | 10021169 | 11/2001 |

(Continued)

*Primary Examiner*—Lorna M Douyon
*Assistant Examiner*—Tanisha Diggs
(74) *Attorney, Agent, or Firm*—Wood, Herron & Evans, L.L.P.

(57) ABSTRACT

One method includes applying to a post-manufactured textile material a liquid composition resulting from a combination of ingredients. The ingredients include one or more anti-fading compounds, one or more anti-soiling compounds, one or more silicon-based compounds, and one or more carrying media. One composition is a liquid composition resulting from a combination of ingredients, with the ingredients including a benzotriazole, a fluorocarbon, an organosiloxane, and odorless mineral spirits.

19 Claims, No Drawings

U.S. PATENT DOCUMENTS

| | | | | |
|---|---|---|---|---|
| 4,900,469 | A | | 2/1990 | Farr et al. |
| 4,923,623 | A | | 5/1990 | Coffindaffer |
| 4,937,123 | A | | 6/1990 | Chang et al. |
| 4,946,768 | A | | 8/1990 | Vallarino |
| 4,956,447 | A | | 9/1990 | Gosselink et al. |
| 5,025,050 | A | | 6/1991 | Torres |
| 5,025,052 | A | | 6/1991 | Crater et al. |
| 5,059,420 | A | | 10/1991 | Scholla et al. |
| 5,062,971 | A | | 11/1991 | Coffindaffer et al. |
| 5,064,543 | A | | 11/1991 | Coffindaffer et al. |
| 5,089,160 | A | | 2/1992 | Pallone et al. |
| 5,100,566 | A | | 3/1992 | Agbomeirele et al. |
| 5,134,223 | A | | 7/1992 | Langer et al. |
| 5,139,687 | A | | 8/1992 | Borgher, Sr. et al. |
| 5,143,729 | A | | 9/1992 | Thompson |
| 5,197,991 | A | | 3/1993 | Rembold |
| 5,234,610 | A | | 8/1993 | Gardlik et al. |
| 5,244,951 | A | | 9/1993 | Gardiner |
| 5,294,662 | A | | 3/1994 | Moore et al. |
| 5,300,357 | A | | 4/1994 | Gardiner |
| 5,330,672 | A | | 7/1994 | Langer et al. |
| 5,338,061 | A | | 8/1994 | Nelson et al. |
| 5,350,795 | A | | 9/1994 | Smith et al. |
| 5,370,919 | A | | 12/1994 | Fieuws et al. |
| 5,374,362 | A | | 12/1994 | McFarland |
| 5,380,778 | A | | 1/1995 | Buckanin |
| 5,382,639 | A | | 1/1995 | Moore et al. |
| 5,409,619 | A | | 4/1995 | DeRenzo |
| 5,451,622 | A | | 9/1995 | Boardman et al. |
| 5,458,924 | A | | 10/1995 | Kashiwai et al. |
| 5,474,691 | A | | 12/1995 | Severns |
| 5,486,297 | A | | 1/1996 | Marin-Carrillo et al. |
| 5,516,337 | A | | 5/1996 | Nguyen |
| 5,516,578 | A | | 5/1996 | Coppens |
| 5,534,165 | A | | 7/1996 | Pilosof et al. |
| 5,552,066 | A | | 9/1996 | Rahman et al. |
| 5,560,852 | A | | 10/1996 | Mura |
| 5,573,695 | A | | 11/1996 | Targosz |
| 5,578,298 | A | | 11/1996 | Berthiaume et al. |
| 5,595,675 | A | | 1/1997 | Aso et al. |
| 5,616,151 | A | | 4/1997 | Sargent et al. |
| 5,637,348 | A | | 6/1997 | Thompson et al. |
| 5,643,498 | A | | 7/1997 | Li et al. |
| 5,645,751 | A | | 7/1997 | Haley |
| 5,672,651 | A | | 9/1997 | Smith |
| 5,674,427 | A | | 10/1997 | Videbaek et al. |
| 5,674,592 | A | | 10/1997 | Clark et al. |
| 5,688,758 | A | | 11/1997 | Reinehr et al. |
| 5,695,528 | A | | 12/1997 | Komori et al. |
| 5,695,677 | A | | 12/1997 | Silvester et al. |
| 5,700,394 | A | | 12/1997 | Isharani et al. |
| 5,705,083 | A | | 1/1998 | Wyss et al. |
| 5,705,474 | A | | 1/1998 | Severns et al. |
| 5,707,540 | A | | 1/1998 | Maruyama et al. |
| 5,714,082 | A | | 2/1998 | Boardman et al. |
| 5,716,667 | A | | 2/1998 | Kashiwada et al. |
| 5,723,435 | A | | 3/1998 | Severns |
| 5,725,789 | A | | 3/1998 | Huber et al. |
| 5,728,771 | A | | 3/1998 | Tang et al. |
| 5,733,855 | A | | 3/1998 | Severns |
| 5,738,687 | A | | 4/1998 | Kamrath et al. |
| 5,744,201 | A | | 4/1998 | Chang et al. |
| 5,752,980 | A | | 5/1998 | Pedersen et al. |
| 5,752,981 | A | | 5/1998 | Fornelli |
| 5,756,181 | A | | 5/1998 | Wang |
| 5,759,431 | A | | 6/1998 | Nguyen |
| 5,763,387 | A | | 6/1998 | Severns et al. |
| 5,783,544 | A | | 7/1998 | Trinh et al. |
| 5,803,929 | A | | 9/1998 | Saito et al. |
| 5,810,889 | A | | 9/1998 | Kaufmann et al. |
| 5,811,483 | A | * | 9/1998 | Close ..... 524/500 |
| 5,817,249 | A | | 10/1998 | Audenaert et al. |
| 5,854,200 | A | | 12/1998 | Severns et al. |
| 5,858,023 | A | | 1/1999 | Bamford et al. |
| 5,869,443 | A | | 2/1999 | Severns |
| 5,879,749 | A | | 3/1999 | Rodrigues et al. |
| 5,882,762 | A | | 3/1999 | Goeman |
| 5,908,663 | A | | 6/1999 | Wang et al. |
| 5,922,088 | A | | 7/1999 | Cole et al. |
| 5,939,379 | A | | 8/1999 | Eckhardt et al. |
| 5,945,396 | A | | 8/1999 | Eckhardt et al. |
| 5,952,284 | A | | 9/1999 | Finch et al. |
| 5,955,005 | A | | 9/1999 | Heller et al. |
| 5,958,083 | A | | 9/1999 | Onishi et al. |
| 5,962,402 | A | | 10/1999 | Severns |
| 5,965,517 | A | | 10/1999 | Mooney |
| 5,968,203 | A | | 10/1999 | Brown |
| 5,968,404 | A | | 10/1999 | Trinh et al. |
| 5,973,055 | A | * | 10/1999 | Michaud et al. ..... 524/462 |
| 5,976,397 | A | | 11/1999 | Wilkes |
| 5,997,759 | A | | 12/1999 | Trinh et al. |
| 6,011,104 | A | | 1/2000 | Udy |
| 6,013,323 | A | | 1/2000 | Klayder et al. |
| 6,015,504 | A | | 1/2000 | Reinehr et al. |
| 6,034,003 | A | | 3/2000 | Lee |
| 6,036,946 | A | | 3/2000 | Greene |
| 6,037,280 | A | | 3/2000 | Edwards et al. |
| 6,043,209 | A | | 3/2000 | Micciche et al. |
| 6,054,601 | A | | 4/2000 | Standke et al. |
| 6,077,318 | A | | 6/2000 | Trinh et al. |
| 6,106,738 | A | | 8/2000 | Woo et al. |
| 6,110,978 | A | | 8/2000 | Graveson et al. |
| 6,117,189 | A | | 9/2000 | Reinehr et al. |
| 6,120,704 | A | | 9/2000 | Martini et al. |
| 6,146,664 | A | | 11/2000 | Siddiqui |
| 6,159,548 | A | | 12/2000 | Moody |
| 6,165,545 | A | | 12/2000 | Moody |
| 6,174,519 | B1 | | 1/2001 | Greene |
| 6,174,854 | B1 | | 1/2001 | Hofer et al. |
| 6,194,329 | B1 | | 2/2001 | Nelson et al. |
| 6,204,353 | B1 | | 3/2001 | Eicken et al. |
| 6,207,014 | B1 | | 3/2001 | de Haut et al. |
| 6,218,552 | B1 | | 4/2001 | Sekihachi et al. |
| 6,277,152 | B1 | | 8/2001 | Kyriazis et al. |
| 6,288,256 | B1 | | 9/2001 | Standke et al. |
| 6,290,867 | B1 | | 9/2001 | Kielbania, Jr. et al. |
| 6,294,511 | B1 | | 9/2001 | Argo et al. |
| 6,296,670 | B1 | | 10/2001 | Rusche et al. |
| 6,323,014 | B1 | | 11/2001 | Breel et al. |
| 6,331,511 | B1 | | 12/2001 | Genova et al. |
| 6,376,456 | B1 | | 4/2002 | Murphy et al. |
| 6,391,065 | B1 | | 5/2002 | Cooke |
| 6,398,982 | B1 | | 6/2002 | Hofer et al. |
| 6,417,861 | B1 | | 7/2002 | Deering et al. |
| 6,424,343 | B1 | | 7/2002 | Deering et al. |
| 6,454,876 | B1 | | 9/2002 | Ochomogo et al. |
| 6,478,980 | B2 | | 11/2002 | Nigam |
| 6,482,757 | B2 | | 11/2002 | Vogt et al. |
| 6,491,840 | B1 | | 12/2002 | Frankenbach et al. |
| 6,495,057 | B1 | | 12/2002 | Kasson et al. |
| 6,495,058 | B1 | | 12/2002 | Frankenbach et al. |
| 6,503,413 | B2 | | 1/2003 | Uchiyama et al. |
| 6,521,683 | B1 | | 2/2003 | Simmons et al. |
| 6,524,494 | B2 | | 2/2003 | Hart et al. |
| 6,528,013 | B1 | | 3/2003 | Trinh et al. |
| 6,531,440 | B1 | | 3/2003 | White |
| 6,569,344 | B1 | | 5/2003 | Hubesch et al. |
| 6,569,345 | B1 | | 5/2003 | Hubesch et al. |
| 6,610,214 | B2 | | 8/2003 | Goldenhersh et al. |
| 6,613,244 | B2 | | 9/2003 | Fry |
| 6,645,392 | B2 | | 11/2003 | Frankenbach et al. |
| 6,649,686 | B1 | | 11/2003 | Peters |
| 6,652,766 | B1 | | 11/2003 | Frankenbach et al. |
| 6,656,923 | B1 | | 12/2003 | Trinh et al. |

| | | | | |
|---|---|---|---|---|
| 6,702,951 | B2 | 3/2004 | Shultz | |
| 6,723,253 | B2 | 4/2004 | Dominguez et al. | |
| 6,740,413 | B2 | 5/2004 | Klun et al. | |
| 6,746,617 | B2 | 6/2004 | Radomyselski et al. | |
| 6,750,277 | B1 | 6/2004 | Yamana et al. | |
| 6,755,987 | B1 | 6/2004 | Hubesch et al. | |
| 6,794,431 | B1 * | 9/2004 | Rosania et al. | 524/35 |
| 2003/0121107 | A1 | 7/2003 | Scheper et al. | |
| 2003/0162868 | A1 | 8/2003 | Stretanski et al. | |
| 2004/0004206 | A1 | 1/2004 | Kelley et al. | |
| 2004/0016060 | A1 | 1/2004 | Detering et al. | |
| 2004/0111805 | A1 | 6/2004 | Ehlis et al. | |

FOREIGN PATENT DOCUMENTS

| | | |
|---|---|---|
| EP | 0523956 | 1/1993 |
| WO | 98/33854 | 8/1998 |
| WO | 02079563 | 10/2002 |
| WO | 03/023122 | 3/2003 |

* cited by examiner

METHODS AND COMPOSITIONS FOR IMPROVING LIGHT-FADE RESISTANCE AND SOIL REPELLENCY OF TEXTILES AND LEATHERS

CROSS-REFERENCE TO RELATED APPLICATION

This patent document is a continuation-in-part of U.S. patent application Ser. No. 10/887,034, filed on Jul. 8, 2004, which claims priority to U.S. Provisional Patent Application No. 60/485,623 entitled "Compositions and Methods for Protecting Textiles from Light and Soil," filed on Jul. 8, 2003. The entire disclosure of U.S. patent application Ser. No. 10/887,034 is incorporated into this patent document by reference.

BACKGROUND OF THE INVENTION

1. Field of Invention

The invention generally relates to compositions for protecting textiles from light and soil, and in particular, for inhibiting or preventing color fade and related damage from sunlight. The invention also relates to methods of use for the compositions.

2. Description of Related Art

Textiles comprise a multitude of fibers. The fibers are generally of two types: (1) natural fibers, such as protein fibers (wool, silk) from animals or cellulosic fibers (cotton) from plants; and (2) synthetic fibers, such as nylon, polyester, olefin, and acrylic fibers, that are man-made from thermoplastic materials. While these individual fibers have certain beneficial properties, they also suffer from various weaknesses. For example, wool has good absorbence allowing for good reactivity with dyes, but wool also stains very easily and is difficult to clean. Cellulosic fibers, such as cotton and rayon (a reformulated form of cotton and wood pulp), are susceptible to the effects of light, and particularly sunlight, which causes loss of color intensity on the fiber. Linen, a natural fiber derived from flax, loses strength and color when exposed to sunlight.

While synthetic fibers are popular, inexpensive, heat resistant, and durable, in general, they too have certain deficiencies. For example, polyester is susceptible to oil stains. Olefinic fibers are not resilient and are crushed under constant weight. Synthetic fibers, in general, are also susceptible to light, and fade or discolor upon exposure thereto. Thus, there is a need to protect fibers from the damaging effects of light, particularly sunlight, and from contact with stain-producing substances and physical stress.

Many textile materials experience sun fade. "Sun fade" is generally defined as "the gradual, irreversible loss of color intensity due to exposure to sunlight." Sun fade is more common in areas of high solar intensity, such as in the sunbelt states in the U.S. and tropical and subtropical climates, than in colder climates. Sun fade occurs on fibers which are exposed to direct sunlight, and generally does not appear on fibers located in shaded areas, such as behind or under furniture, or inside rooms receiving no sunlight.

The ultra-violet (UV) and visible regions of light are responsible for color fading on textiles. More specifically, light in the near UV region of 315 nm-400 nm (also known as UV-A) contributes more to fading than light in the region of 280 nm-315 nm (also known as UV-B), which in turn contributes more to fading than light in the far UV region of 100 nm-280 nm (also known as UV-C). Visible light (380 nm-770 nm) also contributes to color fade and is thought to contribute more to light fading than UV-A. For example, visible light-induced oxidation of dyes on fibers generally causes the color intensity to fade. Thus, there is a need to protect fibers from the color-fading effects of UV and visible light.

The textile industry has proposed a number of ways to address the problem of color fading and, particularly, the loss of dye color intensity of a textile from light. For example, an experienced dye technician may simply re-dye the faded fabric in an effort to restore the color. However, this method of correction is dependent upon fiber type. Unlike fibers such as nylon and wool, some fibers generally do not dye well on-site. In addition, this method is quite expensive, and it is often difficult to accurately match non-re-dyed areas of the fabric. As an alternative to re-dyeing, direct sunlight can be blocked with draperies or shades, or by applying UV-blocking films to windows. Generally, these measures are not desirable because they reduce the overall lighting of the room.

More recently, compounds, generally characterized as UV absorbers, UV blockers, UV inhibitors, light stabilizers, light inhibitors, antioxidants, and the like, have been developed to reduce or prevent the fading of colors and deterioration of textiles caused by light. UV absorbing agents such as para-aminobenzoic acid (PABA) have been used for nearly half a century as UV screening agents. U.S. Pat. No. 4,153,744 teaches the use of a tetrakis (hydroxymethyl) phosphonium salt to impart resistance to UV light-induced color change in vat-dyed cellulosic textile materials. Similarly, U.S. Pat. No. 4,788,054 teaches the use of N-phenylphthalisoimides as ultraviolet radiation absorbers for cotton, wool, polyester, and rayon fabrics.

Foreign matter, either solids or liquids, and generally referred to as "soil", that contacts a textile also causes damage to the textile. The damage may be costly, generally requiring repair of the damaged area, and may even require replacement of the entire textile. Poly(ethylene terephthalate)/poly(ethylene glycol) has been shown to absorb onto hydrophobic surfaces of textile fibers, thereby conferring soil-release properties to such textiles.

However, there is a need for improved methods and compositions for use with textile materials.

SUMMARY OF THE INVENTION

The present invention provides such improved methods and compositions. To this end, and in accordance with the principles of the invention, the compositions include at least one anti-fading compound for improving a textile material's resistance to light-induced color fading, such as sun fade and other related damage. In one aspect of the invention, the compositions may further improve a textile material's resistance to soil-induced degradation. Accordingly, the compositions may further include at least one anti-soiling compound. Also the compositions may include one or more silicon-based polymers, thereby enhancing water repellency. The compositions may be formulated into a solid or a liquid. A liquid solution or suspension is prepared by diluting the composition with a suitable carrying medium such as an aliphatic petroleum naptha, an alcohol, an organic solvent, an inorganic solvent, water, and combinations thereof. Solutions are conveniently applied to the textiles by spraying, brushing, or other conventional methods, and dried to provide protection. Level and duration of protection generally depend on the solubility, concentrations, and properties of the anti-fading compounds, anti-soiling compounds, silicon-base polymers, additives, and the like, employed in the formulation, as well as the types and blends of fibers in the textiles, the dye type and color pigment concentrations on the fibers, and the amount of sunlight exposure and physical usage. Concentrations ranging from about 0.01% to about 25% by weight of the composition are generally effective for protection and provide safety in use. However, the concentrations are not so limited.

The term "anti-fading compound", as used herein, is intended to refer to any agent capable of providing at least minimal protection of a fiber from UV light, visible light, or both. Thus, the anti-fading compounds protect textiles, and fibers in particular, from damage caused by sunlight as well as incandescent light. Anti-fading compounds suitable for the invention include, without limitation, UV absorbers, UV blockers, UV inhibitors, light stabilizers, light inhibitors, HALS (Hindered Amine Light Stabilizers), antioxidants, and combinations thereof, known to be effective. Examples of suitable UV absorbers include, without limitation, substituted or unsubstituted compounds of benzophenones, benzotriazines, benzotriazoles, succinimides, aliphatic and aromatic dioic acids, benzoxyoxazin-ones, and polymers of various substituted or unsubstituted monomers, such as polypropylene, polyethylene, acrylic acids, or other alkyl, alkenyl, and aryl polymeric units. Many compounds in the above-described classes are also suitable antioxidants. Effective concentrations for the anti-fading agent, and for UV absorbers in particular, are generally in the range from about 0.01% to about 15% by weight of the composition. However, the concentration is not limited to this range. For example, for textiles and end-user textile products exposed to high light intensity, and particularly in areas of high sunlight, concentrations higher than 15% by weight may be useful.

The compositions may include at least one anti-soiling compound. Examples of anti-soiling compounds include various polymeric compounds and other non-fluorocarbon compounds. Additional examples include fluorocarbons or fluorochemicals such as $C_1$-$C_{20}$ linear, branch, cyclic, and substituted or unsubstituted aliphatic hydrocarbons having one or more fluorine substitutions thereon. Many anti-soiling compounds are organic or hydrophobic in nature and are readily soluble in organic or hydrophobic carrying agents such as aliphatic petroleum napthas. Others may be more hydrophilic, having greater water solubility, and therefore be more suitable as a part of water-based or hydrophilic compositions of the present invention. The anti-soil compound may be added in a concentration ranging from about 0.01% to about 12% by weight of the composition. However, concentrations may be as high as 90% depending upon the concentration of other components and particular desired properties and applications of the composition.

In another aspect of the invention, at least one silicon-based polymer, such as a silane, is added to the composition. Silanes, such as an organo-functional silane, are generally known for their hydrophobic properties and, therefore, generally impart water-repellent properties to the fiber. Accordingly, silanes may provide a barrier to water on the surface of the fibers, thereby making the fabric surfaces water-repellent. The silicon-based polymer may be included in various concentration ranges depending upon application and targeted use of the particular textile. For example, a silane present in a concentration ranging from about 0.01% to about 25% by weight of the composition may be suitable for compositions whose applications are designed for interior as well as exterior textiles. However, silane concentrations higher than 25% may be desirable in compositions designed for use on outside patio fabric, upholstered fabric, automobile interiors, and textile surfaces that are generally exposed to higher water content and/or moisture.

The present compositions may optionally include other conventional additives known to those of ordinary skill in the art for the purposes of imparting desired properties. For example, additives imparting fragrance, stability, hydrophobicity, pH, and other sensory, physical and chemical properties to render the composition aesthetically pleasing, safe, convenient, and easy to use may be added to the composition.

Thus, there are provided improved compositions and methods for use on textiles and leathers. The compositions are convenient to prepare, inexpensive to use, safe and easy to apply, and may be used as frequently as needed or desired to provide improved light-fade resistance and soil-repellency. These and other objects and advantages of the present invention will be further appreciated in light of the following detailed description.

DETAILED DESCRIPTION OF THE INVENTION

This invention provides compositions and methods for treating textile and leather materials after they've been dyed (i.e., post-dye), after they've been manufactured (i.e., post-manufacture), and even after they've been placed in end-user locations or converted (as appropriate) into end-user products. As used herein, the term "post-manufacture(d)" refers to the point at which a material has been rolled up or baled for transport from a manufacturer, and thereafter. The compositions improve resistance to color fading, deterioration, and related damage due to light and soil. To this end, the compositions include at least one anti-fading compound, such as a UV blocker, a UV absorber, a UV inhibitor, a light stabilizer, a light inhibitor, a HALS compound, or an antioxidant compound, to protect textiles from harmful exposure to UV and visible light thereby preventing damage such as color fade thereto. The compositions may further include one or more anti-soiling, protective compounds, one or more silicon-based, water-repellent compounds, and conventional additives depending on the particular application and intended use of the textile.

The composition is applied to the textile, and may be formulated as a liquid for application. For example, the composition may be mixed with a suitable carrier medium, such as odorless mineral spirits (OMS) or another aliphatic petroleum naptha, an alcohol, water, or a combination thereof to form a solution or suspension. The precise formulation generally depends upon the concentrations and solvation of the anti-fade compound(s), anti-soiling compound(s), silicon-based polymer(s), and other components in the carrier medium. Dilute solutions having the anti-fade compound(s), anti-soiling compound(s), and/or silicon-based polymer(s), each in a concentration of at least about 0.01%, are generally sufficient to provide effective protection and render the solution safe and easy to apply. Accordingly, the formulation may be pre-prepared and stored for later use, either as a concentrate or as a dilute, ready-to-use solution. Concentrates are conveniently diluted with a carrier to form the desired concentration at the time of application.

The compositions of the invention may be used in connection with a number of different textiles. Non-limiting examples include furniture upholstery, panel systems, window treatments, wall coverings, rugs, carpets, upholstered seat covers, boat covers, outdoor furniture, hammocks, tents, sleeping bags, awnings, umbrellas, car covers, and automotive fabrics such as seat upholstery, carpeting, mats, and headliners.

The anti-fading compound(s) prevents damage to the textile from light, and in particular, it protects against fading of color or "sun fade". Suitable anti-fading compounds include, without limitation, UV absorbing compounds (generally referred to as UV absorbers), UV blockers, UV inhibitors, light stabilizers, light inhibitors, HALS, and antioxidants. UV absorbing compounds generally have strong conjugation or UV absorbing chromophores. UV absorbing compounds are either organic or inorganic compounds that are capable of absorbing light at wavelengths ranging from about 100 nm to about 450 nm. For the purposes of the invention, the UV absorbing compound is not limited to those compounds capable of absorbing light only in the UV region, but also includes compounds capable of absorbing visible light, particularly, visible light wavelengths just beyond the UV region (405 nm to about 450 nm). The ability to absorb light is a function of the excitation state of the bonds in the compound, and therefore may be influenced by the temperature of the compound during exposure to light. Suitable UV absorbing compounds which may be used in the compositions of the present invention include, without limitation, compounds used in sun screen formulations, as disclosed in U.S. Pat. No. 5,474,691, which disclosure is incorporated herein by reference in its entirety. Additional examples include benzophenone compounds, such as 2-hydroxy-4 methoxybenzophenone; 2-hydroxy-4-dodecyloxybenzophenone; 2-hydroxy-4-n-octyloxy benzophenone; 2,2'-dihydroxy-4,4'-bisulphobutyloxybenzophenone; 2-hydroxybenzophenone; 2,2'-dihydroxy-4-methoxybenzophenone; poly-4-(2-acryloxyethoxy)-2-hydroxybenzophenone; benzotriazole compounds including, without limitation, 2-(2'-hydroxy-3',5'-di-t-amylphenyl) benzotriazole; phenyl, 2-(5-chloro-2H-benzotriazole-2-yl)-6-(1,1-dimethylethyl)-4-methylbenzotriazole; 2-(2'-hydroxy-3',5'-di-t-butylphenyl)-5-chlorobenzotriazole; 2-(2'-hydroxy-5'-methylphenyl) benzotriazole; 2-(2-hydroxy-5-t-octylphenyl)-benzotriazole, and various other phenyl substituted benzotriazoles, as disclosed in U.S. Pat. No. 5,474,691; nitrogen-containing cyclic or heterocyclic aromatic compounds such as triazine compounds including, without limitation, polymers of morpholino-2,4,6-trichloro-1,3,5-triazines, such as 1,6-hexanediamine, N, N'-bis(2,2,6,6-tetramethyl-4-piperidinyl polymers; poly[(6-morpholino-s-triazine-2,4,dyil) [2,2,6,6-tetramethyl-4-piperidyl) immuno]-hexamethylene [(2,2,6,6-tetramethyl-4-piperidyl) immuno]]; 2-[4,6-bis[2-4-dimethylphenyl]-1,3,5-triazine-2-yl]-5-(octyloxy) phenol; 2,4-bis (2,4-dimethylphenyl)-6-(2-hydroxy-4-isooctyloxyphenyl)-1,3,5-triazine; polymers constructed from gem-dimethyl substituted piperidine compounds such as butanedioic acid, dimethyl ester polymers with 4-hydroxy-2,2,6,6-tetramethyl-1-piperidine ethanol; piperidine substituted succinimides, such as, 3-dodecyl-1-(2,2,6,6-tetramethyl-4-piperidyl-pyrrolidine-2,5,-dione; and other commercially sold UV light stabilizing piperidine substituted succinimides; metal complexes having at least one chromophoric center or conjugated double bond for absorbing light, including, without limitation, nickel complexes such as [2,2-thiobis(4-t-octylphenolato)]-n-butylamine-nickel II and copper complexes; various heterocyclic chromophores including fused heterocyclic ring compounds, such as 2-2'-(1,4-phenylene) bis[4H-3,1-benzoxazin-4-one]; and various homopolymers and copolymers of conventional polymeric monomers, including, without limitation, polypropylene, polyethylene, polyglycol, and the like, having UV absorbing chromophores therein.

Additional chemical compounds known to include chromophores suitable for absorbing UV and visible light include dibenzoylmethane compounds, phenylbenzimidazoles, benzoic acids and esters, such as para-aminobenzoic acid (PABA), 3-5-di-t-butyl-4-hydroxybenzoic acid, hexadecyl ester, esters of cinnamic acid, esters of 2-cyano-3,3-diphenyl-2-propanoic acid, esters of salicylic acid, and mixtures of all of the compounds described above herein. In addition, it has been shown that fatty acid derivatives of PABA, benzophenones, cinnamic acid, and phenylbenzotriazoles; specifically, acetyldimethyl PABA, dimethyl PABA lauryl ester, dimethyl PABA oleyl ester, benzophenone-3-coco acetate ether, benzophenone-3 available, and many others disclosed in U.S. Pat. No. 5,474,691 are suitable for the present invention. The addition of fatty organic moieties may allow the compounds to absorb light at a wavelength of about 315 nm to about 400 nm, generally the more damaging UV-A range within the UV region.

Known sun screen compounds that demonstrate light stability are anti-fading compounds suitable for the present invention. Sun screen compounds that broadly absorb UV-A light would protect the textile against sun fade. The term "light stable", as used herein, generally refers to a UV absorbing agent which does not discolor when exposed to either sunlight or simulated sunlight for approximately 2-60 hours at a temperature from about 25° C. to about 45° C.

UV blockers, UV inhibitors, light stabilizers, light inhibitors, HALS, and the like, known in the art to provide protection against light and light-induced damage are also suitable as the anti-fading compound(s). Exemplary UV blockers suitable for the compositions are disclosed in U.S. Pat. No. 4,946,768, which disclosure is incorporated herein by reference in its entirety.

Antioxidants are compounds capable of protecting the coloring agent or dye on a fiber from light-induced oxidation, which often causes fading of the color or dye intensity on the fiber. Particularly, UV light contains the requisite energy to excite electrons present in conventional dyes, especially electrons in organic dyes containing one or more multiple bonds, to induce or drive the oxidation of the dye in the presence of oxygen causing the dye to fade or lose its color intensity. Antioxidant compounds, however, protect against such dye degradation by preventing the generation of singlet oxygen and peroxy radicals, thereby terminating degradation pathways. Exemplary antioxidants suitable for the compositions are disclosed in U.S. Pat. No. 4,900,469, which disclosure is incorporated herein by reference in its entirety.

A combination of anti-fading compounds may be included in the composition. Combinations of UV absorbing compounds and antioxidants are useful because of their different mechanisms of action for providing protection. The combination of these two mechanisms allows for broad light-induced fade protection. Where a combination is blended as a mixture in solution, the ratio of the antioxidant to the UV absorber may vary within a range from about 1:10 to 10:1. Further, the total amount of the anti-fade compound, whether alone or in combination with other compounds, should be at least about 0.01% by weight of the final composition to be effective. A concentration of up to about 15% by weight is generally sufficient for most applications. However, a concentration higher than 15% may be useful for protecting textiles exposed to high light intensity, or exposed to light for prolonged periods of time. Accordingly, concentrations as high as about 90% may be used.

The composition may further include one or more anti-soiling, protective compounds for providing soil release benefits and properties to the textile. The term "anti-soiling compound", as used herein, is intended to refer to a compound, organic or inorganic, which is capable of creating a barrier between the fiber (textile itself) and a soiling agent or foreign material, whether it is a solid soil or a liquid soil. Thus, an anti-soiling compound generally provides a protective coating on the surface of the fiber, thereby sealing the fiber from penetration of solids and liquids. Moreover, depending upon textile, fiber type, concentration, and amount applied, the anti-soiling agent(s) may even form a barrier along the entire surface of the textile, thereby protecting the airspace between the fibers from penetration of foreign matter or "soiling" of the textile. Such a compound generally allows the textile to be easily cleaned.

Examples of anti-soiling, protective compounds include, without limitation, fluorochemicals such as a fluorocarbon, non-fluorochemical such as a non-fluoro based polymer, known in the art to provide such properties to fabrics. Polymeric soil release compounds useful in the present invention include block copolymers of terephthalate and polyethylene oxide or polypropylene oxide and the like, as disclosed in U.S. Pat. No. 4,956,447, which disclosure is incorporated herein by reference in its entirety. Examples of suitable fluorochemicals are disclosed in U.S. Pat. No. 5,882,762, column 4, line 33 through column 6, line 14. The entire '762 patent is incorporated herein by reference. The anti-soiling compound should be soluble in the carrier medium. To this end, solvent-based anti-soiling compounds are suitable. The anti-soiling compound, when included in the composition, may be present in a concentration of at least about 0.01% by weight. Advantageous properties may be provided by anti-soiling compounds in a concentration ranging from about 0.1% to about 12% by weight of the final composition. However, the invention is not so limited, and concentrations higher than 12% may be included in the composition.

In another aspect of the invention, the composition includes at least one silicon-based polymer. The term "silicon-based polymer(s)", as used herein, is intended to refer to any hydrophobic polymer containing one or more silicon atoms. Silicon-based polymers generally render the composition more hydrophobic in nature. Hydrophobicity conveys water-repellent properties to the textile on which the solution is applied. For example, interior or exterior textiles that are generally exposed to a high content of water and/or moisture, such as outdoor furniture, tents, awnings, boat covers, and the like, may be suitably coated or protected with compositions including a silicon-based polymeric material.

Silicon-based polymers include, without limitation, organofunctional silanes and silicone or other polymers of silicon-containing monomeric units. Suitable organofunctional silanes are commercially available, and include such compounds as methyltrimethoxysilane and phenyltrimethoxysilane. These silanes generally render an inorganic surface hydrophobic, and therefore provide water repulsion and prevent the impregnation of water into the underlying textile. Silicone is an example of a silicon-based polymer, i.e., a semi-inorganic polymer based on the structural unit $(R)_2SiO$ where R is an organic group. Silicone, such as an emulsion of hydroxy-blocked dimethyl silicone fluid is suitable for the composition. A silicone emulsion generally provides good release and lubricity, as well as water repellency and gloss.

Such silicon-based polymer(s) may be utilized in concentrations ranging from at least about 0.01% by weight. In one embodiment, the silicon-based polymer is included in the composition in a concentration ranging from about 0.01% to about 25% by weight. Where silanes are used, they may be hydrolyzed in the presence of water, such as upon contact with a water-based carrier medium or contact with water after having been applied to the textile surface. The hydrolyzed silane may react with the fibers of the textile to form siloxanes, and more strongly adhere the compositions of the invention to the textile.

The compositions of the invention may further include fragrances to render the composition aesthetically pleasing. For example, perfumes or flavors such as lemon and cherry, and citrus aromas or essences may be included. Exemplary cyclodextrine/perfume complexes include, without limitation, those disclosed in U.S. Pat. Nos. 5,139,687 and 5,234,610, whose disclosures are incorporated herein by reference in their entireties. Such perfumes or fragrances are highly desirable and may provide added protection and benefits from complexation with ingredients. Such fragrances and perfumes may be utilized alone or in combination and may generally be present in a concentration ranging from about 0.01% to about 60% by weight of the composition. Smaller concentrations may not overwhelm the senses and generally range from about 0.01% to about 3% by weight.

The compositions may further include other, optional ingredients. For example, ingredients conventionally used in textile treatment compositions include, without limitation, colorants, preservatives, optical brighteners, opacifiers, physical stabilizers such as guar gum and polyethylene glycol, anti-shrinkage agents, anti-wrinkle agents, fabric crisping agents, spotting agents, germicides, fungicides, anti-corrosion agents, anti-foam agents, and the like. In addition, exemplary optional ingredients may include invisible dyes. Invisible dyes are clear under normal light and generally not visible to the naked eye, and therefore would not affect the color of the textile or fabric. Invisible dyes, however, provide the added benefit of filling in excess dye sites in fibers having holes or deteriorated dye, thereby sealing the fiber with respect to vacant dye sites and preventing impregnation or permeation of fluids, such as moisture and water, therein. Further optional ingredients include dye blockers, stabilizing agents, and freeze-thaw agents. Freeze-thaw agents allow the composition to be frozen and thawed without affecting the integrity and/or activity of the ingredients. Alcohols are but one example of freeze-thaw agents. Wetting agents and other similar agents may be included to lower the dyne count with respect to water. Wetting agents generally reduce the surface tension and adhesion coefficient of water to adhere and be absorbed onto the fiber thereby modifying the properties of the underlying textile or fabric. Surfactants, for example, lower dyne count and may be utilized in the compositions of the present invention.

The compositions of the invention may be formulated in a suitable solution that should be easily and conveniently applied to the textile. To this end, suitable carrier media include odorless mineral spirits or another aliphatic petroleum naptha, alcohol, organic solvents, inorganic solvents, water, and combinations thereof which may be utilized to solubilize the composition. Alcohols such as methanol, ethanol, propanol, isopropanol, butanol, sec-butanol, tert-butanol, and others may be utilized in amounts necessary to dissolve the composition. Water may also be utilized depending on the solubility and hydrophobicity of the ingredients included therein. The water may be de-ionized to prevent reactivity with particular anti-fading agents, and should at least be filtered prior to dilution of the composition. Particularly, the hardness in the water should be removed, and "soft" water should be used to form the final solutions. Other "treated" or "refined" water is also suitable. Aliphatic petroleum naphthas such as mineral spirits or LPA-170 Solvent, common alcohols such as methanol and ethanol, and organic solvents generally readily evaporate, thereby allowing the applied solution to dry quickly and provide safety in use. Water is generally considered safe as a carrier. In addition, these carriers are generally inexpensive and readily available.

The carrier media may be selected and utilized in various concentrations ranging from about 1% by weight to about 99% by weight of the composition. In one example, a non-aqueous, solvent based composition provides, as a suitable carrier media, an aliphatic petroleum naptha, e.g., LPA-170 Solvent, which is commercially available from SASOL North America, Inc. of Houston, Tex. Such aliphatic petroleum naptha, in one embodiment, may be present in the composition in an amount no less than about 48% by weight and no more than about 99% by weight of the composition. In another embodiment, the aliphatic petroleum naptha may be present in an amount no less than about 73% by weight and no more than about 99% by weight of the composition. And, in yet another embodiment, the aliphatic petroleum naptha may be present in an amount no less than about 85% by weight and no more than about 99% by weight of the composition. Specific examples of such non-aqueous, solvent-based composition are provided further below.

The invention also provides methods of use or applications of the compositions described above on textiles and leathers. Liquid solutions and other formulations of the composition may be applied to the textile by conventional methods. For example, a solution of the composition may be provided in a suitable dispenser such as a spray applicator or pressurized spraying system, and conveniently sprayed on the surface of the textile. As another example, for carpeting and rugs previously installed in a home or commercial building, and for wall coverings and the like, the solution may conveniently be sprayed thereon, and particularly sprayed on non-faded or partially faded areas of the textile that are exposed to light such as sunlight, thereby preventing fading of the textile. One of ordinary skill in the art will readily appreciate that the method of application generally depends upon the particular textile or leather, as well as the particular end-user product. After application, the solutions are generally allowed to air dry to form a coating on the textile, thereby inhibiting UV and visible light penetration and damage therein. Solutions having mineral spirits or small quantities of alcohol as the carrier base generally require little time to dry. Formulations having a higher water content, however, may require longer drying periods or mechanically-accelerated drying, as appreciated by one of ordinary skill in the art. Other factors influencing the drying period include the drying temperature and the humidity and flow of the air around the textile during drying.

The extent of application for sufficient protection will vary depending upon the weight and/or surface area of the textile in question and concentration of components in the formulation. Generally, a one-gallon solution having components within the concentration ranges described herein will provide good protection for an area of up to about 2500 square feet (sq. ft.) on most textile applications. Coverage of the formulations will generally decrease as the thickness, pile, and density of the textile increases. Thus, for example, a one-gallon preparation having an anti-fading compound in a concentration ranging from about 0.1% to about 5% by weight, an anti-soiling compound in a concentration ranging from about 0.1% to about 7% by weight, and a fragrance in a concentration ranging from about 0.1% to about 3% by weight of the solution, which sufficiently protects up to 2500 sq. ft. of area of boat and car covers, window treatments, thinner smaller pile rugs and carpets, and other common applications, may only provide up to about 800 sq. ft. of coverage for a thicker, higher pile, more dense rug or carpet. Further, a more-concentrated formulation will generally provide a longer period of protection.

Duration of protection from the compositions of this invention will generally vary according to concentration of components in the formulation, the particular textile to which the composition is applied, e.g., the types and blends of fibers comprising the textile and the density of the textile itself, and the amount of the composition applied to the textile. Generally, solutions of the compositions described herein are suitable for providing an anti-fade lifetime of up to about 50% longer than that provided with manufactured or installed commercial textile products. For example, where a manufactured product, such as a carpet, has an expected color fastness life of about 3 years, the life may be prolonged up to about 50%, or to a color fastness life of up to about 4.5 years, after application of the compositions of the invention. Duration of the protection will also depend upon factors relating to the use and location of the textile, and in particular to the degree and length of exposure of the textile to light and the intensity of the light. For example, duration of sufficient protection will generally be less in areas of high light intensity or sunlight, such as the sunbelt states, and in areas around the tropics and the equator. In such areas, higher concentrations, or more-frequent applications, or both, are recommended for improved protection of the textile. Also, repeated treatments or more frequent applications generally prolong the color intensity and provide protection against color fade and soil-related damage for longer periods of time.

In one embodiment of the present invention, the composition includes a commercially available 2-(2'-hydroxy-3',5'-di-t-amylphenyl) benzotriazole, in a concentration ranging from about 0.01% to about 5% by weight, a solvent-based fluorochemical present in a concentration ranging from about 0.01% to about 12% by weight, and a fragrance. The composition is formulated into a solution by dissolving the components in odorless mineral spirits or other aliphatic petroleum naphtha, such as LPA-170 Solvent available from SASOL North America, Inc. of Houston, Tex.

In another embodiment, the composition includes 2-(2'-hydroxy-3',5'-di-t-amylphenyl) benzotriazole in a concentration ranging from about 0.1% to about 1.5% by weight, a solvent-based fluorochemical in a concentration range from about 6% to about 8% by weight, a fragrance in a concentration ranging from about 0.01% to about 25% by weight, and a silicon-based polymeric material, such as an organofunctional silane, in a concentration ranging from about 0.01% to about 2% by weight.

In another embodiment, the composition includes 2-(2'-hydroxy-3',5'-di-t-amylphenyl) benzotriazole in a concentration ranging from about 0.1% to about 1.5% by weight, a fragrance in a concentration ranging from about 0.01% to about 25% by weight, and an organofunctional silane in a concentration ranging from about 0.01% to about 10% by weight.

In another embodiment, the composition includes a UV absorber in a concentration range of about 0.01% to about 5% by weight, an organofunctional silane in a concentration ranging from about 0.01% to about 3% by weight, and a fragrance in a concentration ranging from about 0.01% to about 3% by weight.

In another embodiment, the composition includes one or more anti-fading compounds in a concentration ranging from about 1% to about 50% by weight, one or more organic-solvent-based anti-soiling compounds in a concentration ranging from about 1% to about 98% by weight, and one or more silicon-based polymers in a concentration ranging from about 1% to about 50% by weight of the final composition.

In another embodiment, the composition includes one or more anti-fading compounds in a concentration ranging from about 0.01% to about 25%, and one or more silicon-based polymers in a concentration ranging from about 1% to about 80% by weight of the composition.

In yet another embodiment, the composition is formulated as a concentrate, either a solid or a liquid, for dilution with one or more suitable carrier media prior to application.

100 grams (90.17% by weight of the total composition) of odorless mineral spirits (CAS RN 64742-48-9) were added to a vessel, followed by 0.9 grams (0.81%) of 2-(2'-hydroxy-3', 5'-di-t-amylphenyl) benzotriazole (CAS RN 25973-55-1), and subsequently 8 grams (7.21%) of Flexipel S-11WS Fluorocarbon (Innovative Chemical Technologies of Marietta, Ga.). Then 1 gram (0.90%) of isopropanol anhydrous, ACS (CAS RN 67-63-0, from Dow Chemical Company of Midland, Mich.) and 1 gram (0.90%) of fragrance (product code SZ 12027 from J & E Sozio, Inc. of Edison, N.J.) were added. These ingredients were mixed together with an axial flow mixer. In another example, odorless mineral spirits is substituted with LPA-170 Solvent, which is another aliphatic petroleum naphtha.

The resulting composition may be applied to a textile or a leather, thereby improving the light-fade resistance, water-based- and non-water-based-liquid repellency, and soil repellency of the textile or leather. Non-limiting examples of suitable textiles include window treatments, upholstery fabrics, oriental rugs, area rugs, wall-to-wall carpeting, hand- or machine-woven floor coverings, and some paper- and fabric-wall coverings.

100 grams (89.29% by weight of the total composition) of odorless mineral spirits (CAS RN 64742-48-9) were added to a vessel, followed by 2 grams (1.79%) of 2-(2'-hydroxy-3',5'-di-t-amylphenyl) benzotriazole (CAS RN 25973-55-1), and subsequently 6 grams (5.36%) of FS-4590 Fluorocarbon Fiber Shield of Yaplank, N.Y.). Then 2 grams (1.79%) of APS-222 Silicone (Advanced Polymer, Inc. of Carlstadt, N.J.) were added. Further, 1 gram (0.89%) of isopropanol anhydrous, ACS (CAS RN 67-63-0 from Dow Chemical Co. of Midland, Mich.) and 1 gram (0.89%) of fragrance (product code SZ 12027 from J & E Sozio Inc. of Edison, N.J.) were added. These ingredients were mixed together with an axial flow mixer. In another example, odorless mineral spirits is substituted with LPA-170 Solvent.

The resulting composition may be applied to a textile, thereby improving the light-fade resistance, soil repellency, and water repellency of the textile. The composition may be applied to any suitable textile, with non-limiting examples including car-interior textiles (for example, seat upholstery, carpeting, and floor mats), patio furniture, boat-interior textiles (for example, upholstered seat cushions), porch/deck upholstery, and indoor/outdoor carpeting and rugs.

100 grams (87.72% by weight of the total composition) of odorless mineral spirits (CAS RN 64742-48-9) were added to a vessel, followed by 2 grams (1.75%) of 2-(2'-hydroxy-3',5'-di-t-amylphenyl) benzotriazole (CAS RN 25973-55-1), and subsequently 8 grams (7.02%) of FS-4590 Fluorocarbon (Fiber Shield of Yaplank, N.Y.). Then 2 grams (1.75%) of APS-222 Silicone (Advanced Polymer, Inc. of Carlstadt, N.J.) were added. Further, 1 gram (0.88%) isopropanol anhydrous, ACS (CAS RN 67-63-0 from Dow Chemical Co. of Midland, Mich.) and 1 gram (0.88%) of fragrance (product code SZ 12027 from J & E Sozio Inc., of Edison, N.J.) were added. These ingredients were mixed together with an axial flow mixer. In another example, odorless mineral spirits is substituted with LPA-170 Solvent.

The resulting composition may be applied to a textile, thereby improving the light-fade resistance, soil repellency, and water repellency of the textile. The composition may be applied to any suitable textile. For example, if desired, the composition may be applied to awnings, boat covers, tents, sleeping bags, car covers, and umbrellas.

100 grams (88.5% by weight of the total composition) of water, 1 gram (0.88%) of Flexisorb AQ-50 water dispersable UV light absorber (Innovative Chemical Technologies of Marietta, Ga.), 10 grams (8.85%) of Flexipel AM-95 Fluorocarbon (Innovative Chemical Technologies of Marietta, Ga.), 1 gram (0.88%) of isopropanol anhydrous, ACS (CAS RN 67-63-0 from Dow Chemical Co. of Midland, Mich.), and 1 gram (0.88%) of fragrance (product code SZ 12027 from J & E Sozio Inc. of Edison N.J.) are added to a vessel and mixed together with an axial-flow mixer. In another example, odorless mineral spirits is substituted with LPA-170 Solvent.

The resulting composition may be applied to a textile, thereby improving the light-fade resistance and soil repellency of the textile. The composition may be applied to any suitable textile. For example, if desired, the composition may be applied to window treatments, upholstery fabrics, oriental rugs, area rugs, wall-to-wall carpeting, and other interior- and exterior-textiles.

Thus, there are provided compositions and methods for improving light-fade resistance, soil repellency, and water repellency of textiles and leathers. The compositions are easy to use and conveniently applied, and application and treatment may be repeated as necessary. Also, the compositions are inexpensive, safe, and may be utilized as needed.

While the present invention has been illustrated by a description of various embodiments, and while the illustrative embodiments have been described in considerable detail, it is not the intention of the inventor to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A non-aqueous, solvent-based composition comprising;

at least one anti-fading compound chosen from a benzotriazole, the benzotriazole present in an amount of from 0.81% to about 15% by weight of the composition;

at least one anti-soiling compound chosen from a fluorocarbon, the fluorocarbon present in an amount of from 5.36% to about 12% by weight of the composition; and at least one carrier media chosen from an aliphatic petroleum naphtha, the aliphatic petroleum naphtha present in an amount no less than about 48% by weight and no more than about 99% by weight of the composition.

2. The composition of claim 1 wherein the aliphatic petroleum naphtha is present in an amount no less than about 73% by weight and no more than about 99% by weight of the composition.

3. The composition of claim 1 wherein the aliphatic petroleum naphtha is present in an amount no less than about 85% by weight and no more than about 99% by weight of the composition.

4. The composition of claim 1 further comprising at least one water-repellant compound chosen from a silicon-based polymer, the silicon-based polymer present in an amount of from about 0.01% to about 25% by weight of the composition.

5. The composition of claim 1 wherein the ingredients further include a fragrance.

6. A non-aqueous, solvent-based composition comprising:

at least one anti-fading compound present in an amount of from 0.81% to about 15% by weight of the composition;

at least one anti-soiling compound chosen from a fluorocarbon, the fluorocarbon present in an amount of from 5.36% to about 12% by weight of the composition;

at least one water-repellant compound chosen from a silicon-based polymer, the silicon-based polymer present in an amount of from about 0.01% to about 25% by weight of the composition, and at least one carrier media chosen from an aliphatic petroleum naphtha, the aliphatic petroleum naphtha present in an amount no less than about 48% by weight and no more than about 99% by weight of the composition.

7. The composition of claim 6 wherein the aliphatic petroleum naphtha is present in an amount no less than about 73% by weight and no more than about 99% by weight of the composition.

8. The composition of claim 6 wherein the aliphatic petroleum naphtha is present in an amount no less than about 85% by weight and no more than about 99% by weight of the composition.

9. The composition of claim 6 wherein the aliphatic petroleum naphtha is present in an amount of 87.72% to 89.29% by weight of the composition.

10. The composition of claim 9 wherein the anti-fading compound is a benzotriazole, the benzotriazole is present in an amount of 1.75% to 1.79% by weight of the composition, the fluorocarbon is present in an amount of from 5.36% to 7.02% by weight of the composition, and the silicone based polymer is present in an amount of 1.75% to 1.79% by weight of the composition.

11. A method comprising:

applying to a post-dyed textile material a non-aqueous, solvent-based composition comprising:

at least one anti-fading compound is present in an amount of from 0.81 to about 15% by weight of the composition;

at least one anti-soiling compound chosen from a fluorocarbon, the fluorocarbon present in an amount of from 5.36% to about 12% by weight of the composition; and at least one carrier media chosen from an aliphatic petroleum naphtha, the aliphatic petroleum naphtha present in an amount no less than about 48% by weight and no more than about 99% by weight of the composition.

12. The method of claim 11 wherein the aliphatic petroleum naphtha is present in an amount no less than about 73% by weight and no more than about 99% by weight of the composition.

13. The method of claim 11 wherein the aliphatic petroleum naphtha is present in an amount no less than about 85% by weight and no more than about 99% by weight of the composition.

14. The method of claim 11 wherein the aliphatic petroleum naphtha is present in an amount of 87.72% to 90.17% by weight of the composition.

15. The method of claim 11 wherein the composition further comprises at least one water-repellant compound chosen from a silicon-based polymer, the silicon-based polymer present in an amount of from about 0.01% to about 25% by weight of the composition.

16. The method of claim 15 wherein the aliphatic petroleum naphtha is present in an amount no less than about 73% by weight and no more than about 99% by weight of the composition.

17. The method of claim 15 wherein the aliphatic petroleum naphtha is present in an amount no less than about 85% by weight and no more than about 99% by weight of the composition.

18. The method of claim 15 wherein the aliphatic petroleum naphtha is present in an amount of 87.72% to 89.29% by weight of the composition.

19. The method of claim 18 wherein the anti-fading compound is a benzotriazole present in an amount of 1.75% to 1.79% by weight of the composition, the fluorocarbon is present in an amount of from 5.36% to 7.02% by weight of the composition, and the silicone based polymer is present in an amount of 1.75% to 1.79% by weight of the composition.

* * * * *

UNITED STATES PATENT AND TRADEMARK OFFICE

CERTIFICATE OF CORRECTION

PATENT NO. : 7,824,566 B2
APPLICATION NO. : 11/566460
DATED : November 2, 2010
INVENTOR(S) : Karl J. Scheidler It is certified that error appears in the above-identified patent and that said Letters Patent is hereby corrected as shown below:

Column 13, Line 33, "at least one anti-fading compound is present in an amount of from 0.81 to about 15% by weight of the composition" to --at least one anti-fading compound chosen from a benzotriazole, the benzotriazole present in an amount of from 0.81% to about 15% by weight of the composition--

Signed and Sealed this
Twenty-second Day of March, 2011

David J. Kappos

David J. Kappos
*Director of the United States Patent and Trademark Office*